US010294771B2

(12) United States Patent
Donzier et al.

(10) Patent No.: US 10,294,771 B2
(45) Date of Patent: May 21, 2019

(54) PRODUCTION LOGGING TOOL AND DOWNHOLE FLUID ANALYSIS PROBES DEPLOYING METHOD, IN PARTICULAR FOR DEVIATED AND HORIZONTAL HYDROCARBON WELL

(71) Applicant: OPENFIELD, Versailles (FR)

(72) Inventors: Eric Donzier, Bercheres sur Vesgre (FR); Linda Abbassi, Montigny le Bretonneux (FR); Emmanuel Tavernier, Paris (FR)

(73) Assignee: OPENFIELD, Versailles (FR)

( * ) Notice: Subject to any disclaimer, the term of this patent is extended or adjusted under 35 U.S.C. 154(b) by 141 days.

(21) Appl. No.: 15/430,595

(22) Filed: Feb. 13, 2017

(65) Prior Publication Data

US 2018/0003027 A1 Jan. 4, 2018

(30) Foreign Application Priority Data

Jul. 2, 2016 (EP) ..... 16177670

(51) Int. Cl.
*E21B 47/01* (2012.01)
*E21B 47/00* (2012.01)
(Continued)

(52) U.S. Cl.
CPC ..... *E21B 47/00* (2013.01); *E21B 17/1021* (2013.01); *E21B 47/01* (2013.01); *E21B 47/10* (2013.01)

(58) Field of Classification Search
CPC ..... E21B 47/00; E21B 47/10; E21B 47/01; E21B 17/1021
See application file for complete search history.

(56) References Cited

U.S. PATENT DOCUMENTS 5,052,220 A * 10/1991 Piers ..... E21B 33/126 73/152.36
5,251,479 A 10/1993 Siegfried, II et al.
(Continued)

FOREIGN PATENT DOCUMENTS

EP 2336482 A2 6/2011
GB 2294074 A 4/1996

OTHER PUBLICATIONS

PCT/EP2017/051894 International Search Report, dated Jun. 28, 2017, European Patent Office, P.B. 5818 Patentlaan 2 NL—2280 HV Rijswijk.

(Continued)

*Primary Examiner* — Brad Harcourt
(74) *Attorney, Agent, or Firm* — The Jansson Firm; Pehr B. Jansson

(57) ABSTRACT

A production logging tool to analyze at least one property of a multiphase fluid mixture flowing in a hydrocarbon well has an elongated cylindrical housing shape and comprises a central pressure-resistant rigid housing carrying a centralizer arrangement. The production logging tool further comprises a deploying arrangement nested within the centralizer arrangement comprising deploying arms circumferentially positioned between two centralizer arms, and downhole fluid properties analysis probes secured on each deploying arm such as to expose a tip of said, at least one, probe to the multiphase fluid mixture flowing in the hydrocarbon well. The deploying arrangement follows radial movements imposed by the centralizer arrangement to radially and/or angularly position the tip of the probes in a first circumferential zone of a hydrocarbon well section substantially perpendicular to a longitudinal axis of the well.

16 Claims, 10 Drawing Sheets

(51) Int. Cl.
*E21B 17/10* (2006.01)
*E21B 47/10* (2012.01)

(56) References Cited

U.S. PATENT DOCUMENTS 5,631,413 A * 5/1997 Young ..... E21B 17/1021
73/152.21
2016/0130935 A1* 5/2016 Manzar ..... E21B 47/102
166/250.01

OTHER PUBLICATIONS

PCT/EP2017/051894 Written Opinion of the International Searching Authority, dated Jun. 28, 2017, European Patent Office, D-80298 Munich.

* cited by examiner

PRODUCTION LOGGING TOOL AND DOWNHOLE FLUID ANALYSIS PROBES DEPLOYING METHOD, IN PARTICULAR FOR DEVIATED AND HORIZONTAL HYDROCARBON WELL

TECHNICAL FIELD

The invention relates to a production logging tool and a downhole fluid analysis probes deploying method. Such a production logging tool is used to analyze a multiphase fluid mixture flowing from a hydrocarbon bearing zone into a hydrocarbon well. Such a production logging tool is particularly adapted to a hydrocarbon well comprising from deviated well sections to horizontal well sections where multiphase fluid mixtures exhibit a large degree of segregation. Production logging tools typically operate in the harsh downhole environment of hydrocarbon wells at downhole pressure (typically in the range of one hundred to 2000 bars) and temperature (typically in the range of 50 to 200° C.) conditions, and in corrosive fluid.

BACKGROUND

During the production of a hydrocarbon well, it is necessary to monitor the relative volumetric flow rates of the different phases (e.g. oil, gas and water) of the multiphase fluid mixture flowing into the pipe of the well from the hydrocarbon bearing zones. Further, current hydrocarbon well often comprises vertical well section, deviated well sections and horizontal well sections. The interpretation of the flow in such complex wells is challenging because small changes in the well inclination and the flow regime influence the flow profile. Thus, an accurate monitoring requires sensors or probes capable of imaging a surface section or a volume section of the pipe and providing an estimation of the surface section or the volume section occupied by each phase.

Production logging of hydrocarbon wells (e.g. oil and gas wells) has numerous challenges related to the complexity of the multiphasic flow conditions and the severity of the downhole environment.

Gas, oil, water, mixtures flowing in wells, being either openhole or cased hole wells, will present bubbles, droplets, mist, segregated wavy, slugs structures depending on the relative proportions of phases, their velocities, densities, viscosities, as well as pipe dimensions and well deviations. In order to achieve a good understanding of the individual phases flowrates and determine the relative contributions of each zones along the well, an accurate mapping of fluids types and velocities is required on the whole section of the hole (openhole well portion) or pipe (cased well portion) at different depth (i.e. the measured depth is different from the true vertical depth and generally longer than true vertical depth, due to intentional or unintentional curves in the well).

Further, production issues greatly vary depending on reservoir types and well characteristics resulting in the need for a flexible production logging technology working with different types of sensing physics. For example, due to the phases segregation, deviated wells showing high water cuts require an accurate detection of thin oil layer at the top of the pipe. The effect of well inclination will have a strong impact on velocities and holdups.

Furthermore, high pressure, up to 2000 bars, high temperature, up to 200° C., corrosive fluid ($H_2S$, $CO_2$) put constraints on sensors and tool mechanics.

Furthermore, solids presence in flowing streams can damage equipments. In particular, the sand entrained from reservoir rocks will erode parts facing the fluid flow. Solids precipitated from produced fluids due to pressure and temperature changes, such as asphaltenes, paraffins or scales create deposits contaminating sensors and/or blocking moving parts (e.g. spinners).

Furthermore, the tool deployment into the well can be difficult and risky. In highly deviated or horizontal wells, tools must be pushed along the pipe using coiled tubing or pulled using tractor which is difficult when tools are long and heavy. Pipes may be damaged by corrosion or rock stress which may create restrictions and other obstacles. During the logging operation, equipments can be submitted to high shocks. Thus, in such environments, it is highly preferable to have light and compact tools.

Furthermore, the cost is also an important parameter in order to provide an economically viable solution to well performance evaluation even in mature fields having low producing wells in process of depletion with critical water production problems.

With respect to the hereinbefore described challenges, the state of the art production logging equipments have limitations.

Certain production logging tools available on the market have limited or no pipe section imaging capabilities and work correctly only in near vertical wells. These tools use a gradiomanometer and/or capacitance sensor to identify fluid entries. Further, these tools use spinner rpm and insitu calibration data to compute holdups and flowrates.

Other production logging tools available on the market are intended to identify fluid types from local probe sensors (electrical or optical) and to compute the fluid velocities from miniaturized spinners. Some of these production logging tools comprise probes attached to the centralizer arms creating a two dimensional (2D) array of local measurements. Achieving sufficient coverage requires a large number of arms/probes which leads to complex and expensive designs, tool maintenance is complex and reliability is poor. In addition, the measurements on different phases are made at different positions on a long tool string resulting in interpretation issues. Another production logging tool comprises a one dimensional (1D) array of sensors attached to a moving arm providing a scan of measurements along one line of the pipe section. Thus, the measurements coverage is limited and, depending on tool position, some production zone may be missed. The operation of such complex and costly tools results in important deployment difficulties that render compulsory the presence of highly trained engineering teams on the field.

Other attempts have been made to develop tools with rotating arms in order to improve coverage. The documents U.S. Pat. Nos. 5,531,112 and 5,631,413 describe a production logging tool for use within a well to determine fluid holdup of a multiphase fluid flow within the well. The production logging tool includes a plurality of sensors secured within a plurality of arms which radially extend from a tool housing to points distal from the tool housing. A plurality of sensors are included within the plurality of arms for detecting variations in fluid properties attributable to different flow constituents of the multiphase fluid flow along a path which circumscribes an exterior of the tool housing. The plurality of arms are rotated about the tool housing for moving these sensors through the path in order to ensure that the volumetric proportions of the different flow constituents of the multiphase fluid flow are accurately detected in highly deviated and in horizontal wells. Such production logging tools are complex apparatuses. Their reliability is problematic when taking into account the harsh downhole environment of hydrocarbon wells. In particular, the difficulty of operating motor/shafts mechanics under high pressure and complexity of rotating electrical connections kept such development at prototype level and technology has never been commercialized.

SUMMARY OF THE DISCLOSURE

It is an object of the invention to propose a production logging tool that overcomes one or more of the limitations of the existing apparatus, in particular that is structurally simple and reliable to operate whatever the downhole conditions.

According to one aspect, there is provided a production logging tool to analyze at least one property of a multiphase fluid mixture flowing in a hydrocarbon well having an elongated cylindrical body shape and comprising a central pressure-resistant rigid housing carrying a centralizer arrangement comprising multiple external centralizer arms circumferentially distributed about said housing and adapted for contact with a production pipe wall of a hydrocarbon well and operable from a retracted configuration into a radially extended configuration, the centralizer arms being coupled at a first side to the body and at a second side to a first sliding sleeve and a spring, wherein the production logging tool further comprises a deploying arrangement nested within the centralizer arrangement, the deploying arrangement comprising:

- a plurality of deploying arms circumferentially distributed about said housing and being coupled at a first side to the body and at a second side to the centralizer arrangement by means of at least one second sliding sleeve mechanically coupled to the first sliding sleeve such that each deploying arm is circumferentially positioned between two centralizer arms whatever the retracted or radially extended configuration of the centralizer arrangement,
- at least one downhole fluid properties analysis probe being secured on each deploying arm such as to expose a tip of said, at least one, probe to the multiphase fluid mixture flowing in the hydrocarbon well, wherein the second sliding sleeve comprises a mechanical coupler coupled to the first sliding sleeve such that the deploying arrangement follows radial movements imposed by the centralizer arrangement to radially and/or angularly position the tip of said, at least one, probe associated with each arm in a first circumferential zone of a hydrocarbon well section substantially perpendicular to a longitudinal axis of the well.

At least one other downhole fluid properties analysis probe may be secured on an inner or lateral face of each centralizer arm such as to expose a tip of said other probe to the multiphase fluid mixture flowing in the hydrocarbon well.

The centralizer arrangement is arranged to radially and/or angularly position the tip of said, at least one, probe associated with each centralizer arm in a second circumferential zone of the hydrocarbon well section substantially perpendicular to the longitudinal axis of the well.

The first and second circumferential zone may be confused.

A spring may be positioned between the second sliding sleeve and the body at the first side of the deploying arrangement.

The first sliding sleeve and the second sliding sleeve may be supported by a stem of the central pressure-resistant rigid housing, the stem comprising a longitudinal or an helical guiding slot cooperating with a radial pin of the second sliding sleeve.

Each deploying arm of the deploying arrangement may comprise an extension part, a length of the extension part defining a radial extension of the tip of the downhole fluid properties analysis probe carried by the deploying arm.

The deploying arrangement may comprise at least four centralizer arms and at least four deploying arms, each deploying arm being nested in-between two adjacent centralizer arms.

Two downhole fluid properties analysis probes may be secured on lateral faces of each deploying arm.

Two downhole fluid properties analysis probes may be secured on lateral faces or on one inner face and one lateral face of each centralizer arm.

Said, at least one, probe associated with the centralizer arms may be connected to an electronic module located into a first housing part, said, at least one, other probe associated with the deploying arms may be connected to another electronic module located into a second housing part, a protective tube extending from each electronic module to the tip along the respective arm through a pressure feedthrough of said respective housing part.

According to a further aspect, there is provided a method of deploying downhole fluid analysis probes in a hydrocarbon well in which a multiphase fluid flows, comprising the steps of:

- providing a production logging tool having an elongated cylindrical body shape and comprising a central pressure-resistant rigid housing carrying a centralizer arrangement including a plurality of centralizer arms circumferentially distributed about said housing and operable from a retracted position into a radially extended position and a probe deploying arrangement including a plurality of deploying arms circumferentially distributed about said housing, each deploying arm being circumferentially positioned between two centralizer arms and carrying at least one downhole fluid analysis probe, said deploying arrangement being coupled to said centralizer arrangement so that radial extension of the centralizer arms results in radial extension of the deploying arms,
- positioning the production logging tool in a section of a hydrocarbon well in which multiphase fluid flow is to be analyzed,
- allowing the centralizer arms to radially extend into engagement with the wall of the well, whereby the deploying arms are extended radially and the downhole fluid analysis probes are deployed in positions circumferentially located between two centralizer arms and radially located in a first circumferential zone of a hydrocarbon well section substantially perpendicular to a longitudinal axis of said well.

The deploying method may further comprise providing at least one downhole fluid analysis probe carried on each centralizer arm and deploying said downhole fluid analysis probes in a second circumferential zone of a hydrocarbon well section substantially perpendicular to a longitudinal axis of said well.

Said probes carried by deploying arms and said probes carried by centralizer arms are positioned, when deployed, in the same plane perpendicular to a longitudinal axis of the well.

According to a still further aspect, there is provided an apparatus for deploying in a hydrocarbon well a plurality of probes for analyzing at least one property of a multiphase fluid mixture flowing in the hydrocarbon well, having an elongated cylindrical housing shape and comprising a central pressure-resistant rigid housing carrying a centralizer arrangement comprising multiple external centralizer arms circumferentially distributed about said housing and adapted for contact with a production pipe wall of a hydrocarbon well and operable from a retracted configuration into a radially extended configuration, the centralizer arms being coupled at a first side to the housing and at a second side to a first sliding sleeve and a first spring, wherein the apparatus further comprises a deploying arrangement nested within the centralizer arrangement, the deploying arrangement comprising:

a plurality of deploying arms circumferentially distributed about said housing and being coupled at a first side to the housing and at a second side to the centralizer arrangement by means of at least one second sliding sleeve such that each deploying arm is circumferentially positioned between two centralizer arms whatever the retracted or radially extended configuration of the centralizer arrangement, a plurality of probe attachments for respectively securing probes on each deploying arm and each centralizer arm such as to expose a tip of said probes when secured to said probe attachments to the multiphase fluid mixture flowing in the hydrocarbon well, wherein the second sliding sleeve comprises a mechanical coupler coupled to the first sliding sleeve such that the deploying arrangement follows radial movements imposed by the centralizer arrangement to radially and/or angularly position the tip of said probes when respectively secured to said probe attachments in a first circumferential zone of a hydrocarbon well section substantially perpendicular to a longitudinal axis of said well, and wherein the centralizer arrangement is arranged to radially and/or angularly position the tip of said other probes when respectively secured to said probe attachments in a second circumferential zone of the hydrocarbon well section substantially perpendicular to the longitudinal axis of the well.

The production logging tool of the invention has a simple and compact structure achieving low cost, easy operation and maintenance.

Other advantages will become apparent from the hereinafter description of the invention.

DESCRIPTION OF THE DRAWINGS

The present invention is illustrated by way of examples and not limited to the accompanying drawings, in which like references indicate similar elements.

DETAILED DESCRIPTION OF THE INVENTION

Figure 1:
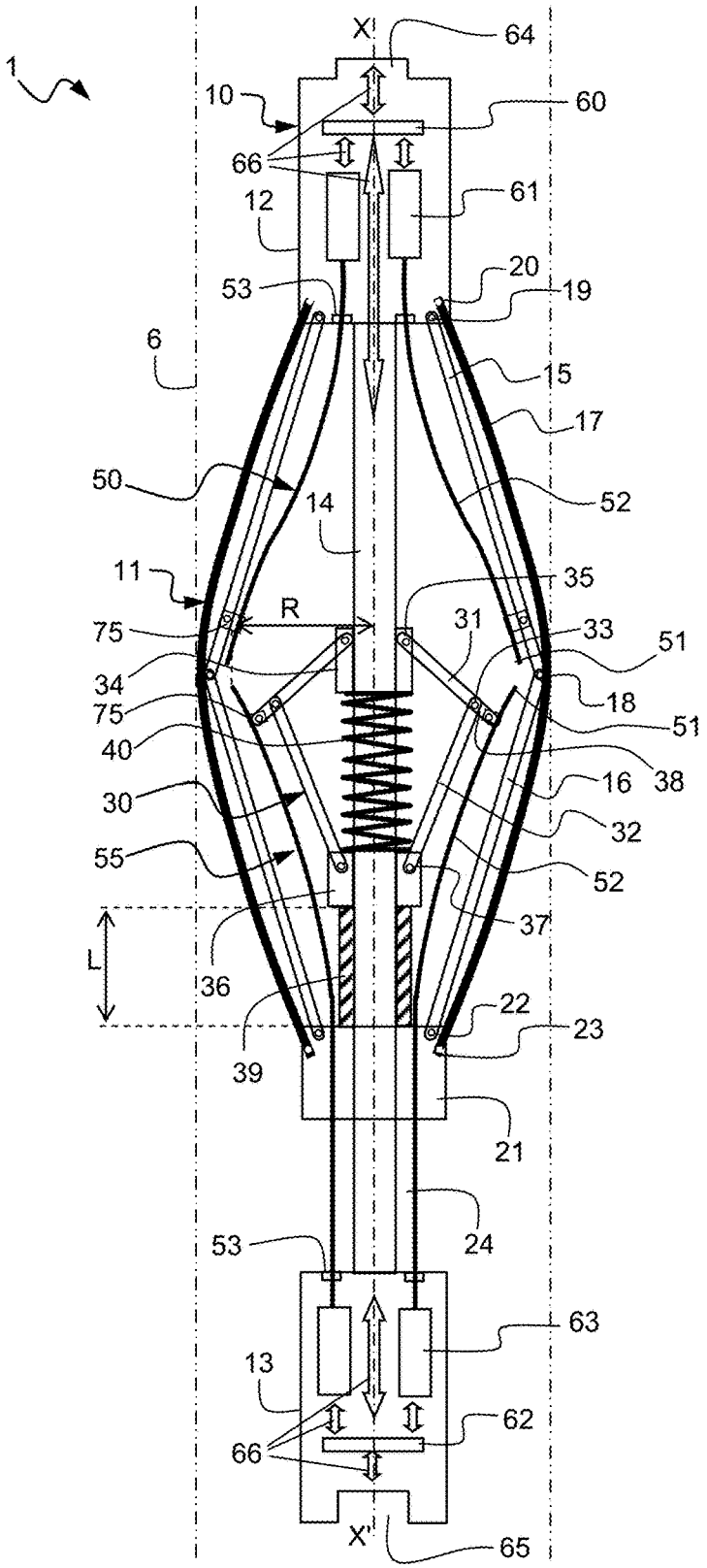
FIG. 1 is a cross-section view schematically illustrating an embodiment of the production logging tool PLT of the invention.
Figure 2:
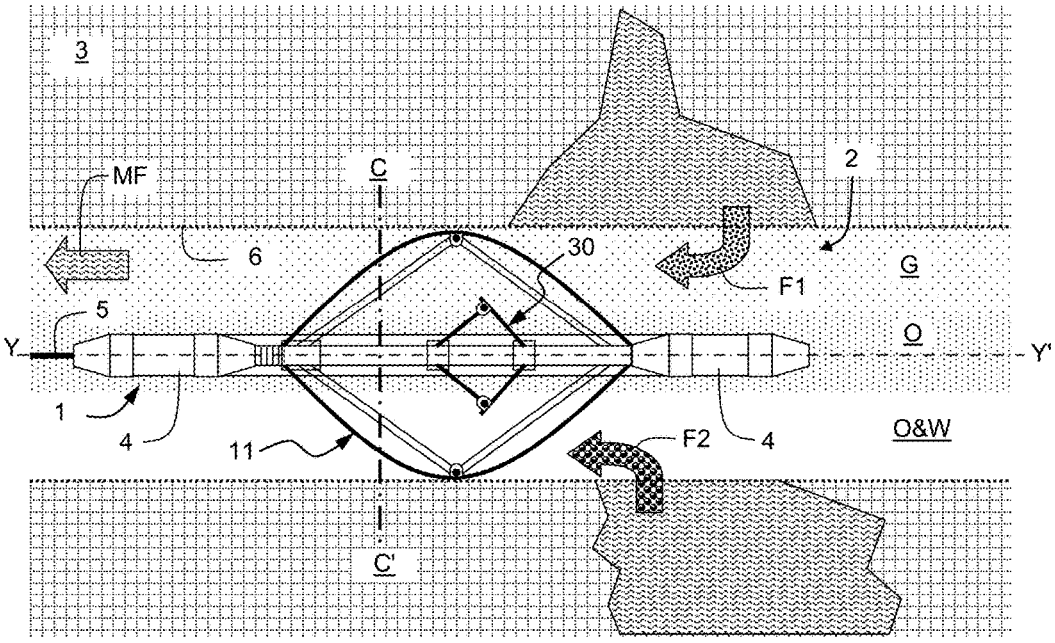
FIGS. 2, 3, 4A and 4B are various cross-section views in a horizontal hydrocarbon well schematically illustrating the operation of the production logging tool PLT of the invention in segregated fluid mixture flowing through the wellbore.

FIG. 1 is a cross-section view schematically illustrating an embodiment of the production logging tool (PLT) 1 of the invention. The production logging tool 1 is used to analyze at least one property of a multiphase flow mixture MF flowing in a hydrocarbon well 2. FIG. 2 is a cross-section view schematically illustrating the production logging tool 1 deployed into a well bore of a hydrocarbon well 2 that has been drilled into an earth subterranean formation 3. The well bore refers to the drilled hole or borehole, including the open hole or uncased portion of the well. The borehole refers to the inside diameter of the wellbore wall, the rock face that bounds the drilled hole. The open hole refers to the uncased portion of a well. While most completions are cased, some are open, especially in horizontal wells where it may not be possible to cement casing efficiently. The production logging tool 1 is suitable to be deployed and run in the well bore of the hydrocarbon well 2 for performing various analysis of the multiphase flow mixture MF properties irrespective of a cased or uncased nature of the hydrocarbon well. The production logging tool 1 may comprise various sub sections 4 having different functionalities and may be coupled to surface equipments through a wireline 5. At least one sub section 4 comprises a measuring device generating measurements logs, namely measurements versus depth or time, or both, of one or more physical quantities in or around the well 2. Wireline logs are taken downhole, transmitted through the wireline 5 to surface and recorded there, or else recorded downhole and retrieved later when the instrument is brought to surface. There are numerous log measurements (e.g. electrical properties including conductivity at various frequencies, sonic properties, active and passive nuclear measurements, dimensional measurements of the wellbore, formation fluid sampling, formation pressure measurement, etc . . . ) possible while the production logging tool 1 is displaced along and within the hydrocarbon well 2 drilled into the subterranean formation 3. Surface equipments are not shown and described in details herein. In the following the wall of the well bore irrespective of its cased (cement or pipe) or uncased nature is referred to wall 6. Various fluid (that may include solid particles) entries F1, F2 may occur from the subterranean formation 3 towards the well bore 2. Once in the well bore 2, these fluid forms a multiphase flow mixture MF that generally is driven to flow towards the surface. In particular, in deviated or horizontal wells, the multiphase fluid mixture MF may be segregated as depicted in FIG. 2. In this particular example, the segregated multiphase flow mixture MF flows as a layer of gas G above a layer of oil O, further above a layer of oil and water mixture O&W from top to bottom (i.e. in the direction of earth gravity in this specific depicted example).

The production logging tool 1 has an elongated cylindrical body shape and comprises a central pressure-resistant rigid housing 10 carrying a centralizer arrangement 11 and a deploying arrangement 30. The production logging tool 1 extends longitudinally about the longitudinal axis XX'. The centralizer arrangement 11 substantially centers the production logging tool 1 with respect to the well bore axis YY' (see FIG. 2) during operations into the well bore. The centralizer arrangement 11 may further position probe tips 51 around a circumference close to the bore wall or pipe wall 6. In this way, the longitudinal axis XX' of the production logging tool 1 and the well bore axis YY' are substantially parallel, generally confused together. Further, when the production logging tool 1 is moved along the well bore, the centralizer arrangement 11 is adapted to fit through borehole of different diameter while offering a minimal frictional resistance as explained hereinafter.

The central pressure-resistant rigid housing 10 comprises, at one end, a first housing part 12 including a master and telemetry electronic module 60 and probe electronic modules 61, at another end, a second housing part 13 that may include another master and telemetry electronic module 62 and other probe electronic modules 63, and, centrally, a stem 14 under the form of an elongated, reduced diameter, hollow tube connecting the first and second housing parts 12, 13. As an example, the stem 14 may be connected to the housing parts 12, 13 by welding or a threaded connection. Both first and second housing part 12, 13 may be fitted with a corresponding pin connector 64, 65 connected to the corresponding master and telemetry electronic module 60, 62, respectively. The different arrows 66 schematically illustrate either connections, or data transfer or power transfer between various electronic components. The master and telemetry electronic module 60 may comprise accelerometer and gyrometer sensors which allow the measurement of tool inclination and relative bearing and, consequently, positions of downhole fluid properties analysis probes (general references 50 and 55 thereafter) within the well section with respect to top and bottom.

Figure 9:
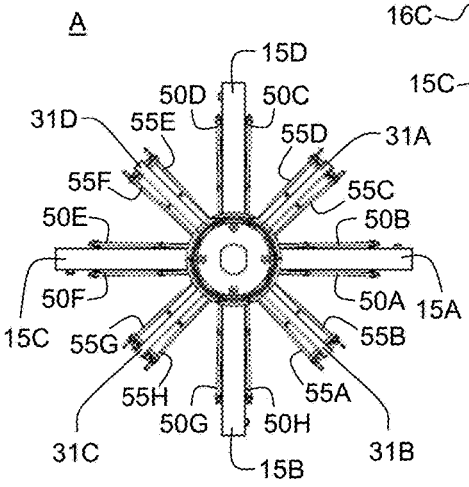
Figure 7:
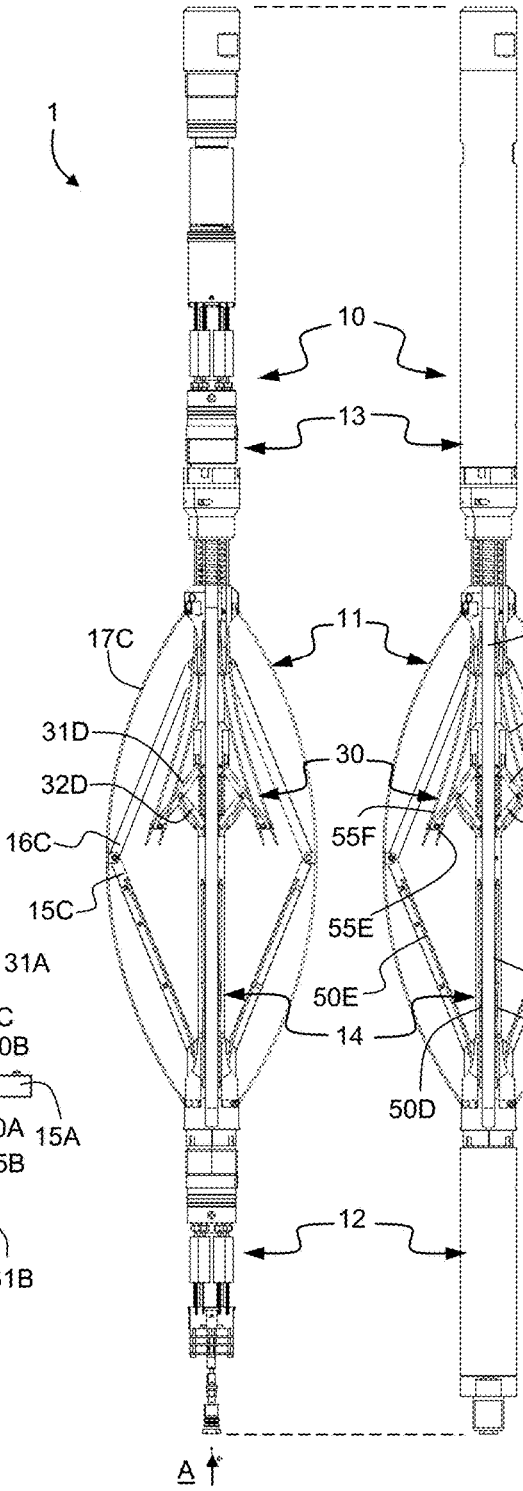
Figure 8:
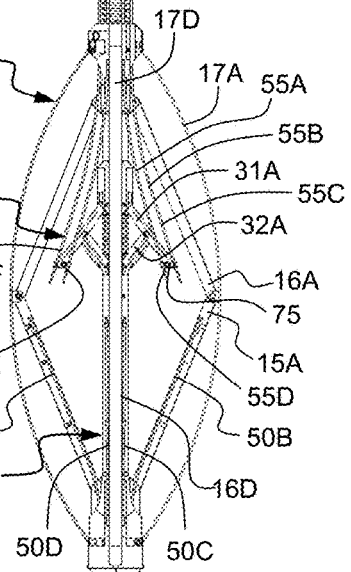

The centralizer arrangement 11 comprises articulated centralizer arms 15, 16 and associated bows 17. The bows 17 are positioned externally with respect to the articulated centralizer arms 15, 16 and to the stem 14 and enter into contacting engagement with the well bore wall or the production pipe wall 6 of the hydrocarbon well 2. In particular the bows 17 are adapted for a smooth and low frictional drag contact with such walls. Each articulated centralizer arm includes a first arm part 15 and a second arm part 16 coupled together by an appropriate pivot connection, e.g. a hinge 18 at one of their ends. The first centralizer arm part 15 and the second centralizer arm part 16 may be identical. The centralizer arms 15, 16 and bows 17 are coupled at a first side to the first housing part 12 of the housing 10 by respective pivot connection, e.g. hinges 19, 20 and at a second side to a first sliding sleeve 21 by respective pivot connection, e.g. hinges 22, 23. The first sliding sleeve 21 can slide on the stem 14. As an example, the present embodiment comprises a centralizer arrangement 11 including four centralizer arms 15A, 16A, 15B, 16B, 15C, 16C, 15D, 16D and their respective bows 17A, 17B, 17C, 17D (see FIGS. 9-11). The four centralizer arms are spaced apart circumferentially about the longitudinal axis XX' of the production logging tool 1. The four centralizer arms may be identical and equally spaced on the circumference. The centralizer arrangement 11 further comprises a first axial spring element, e.g. a first coil spring 24 extending around the stem 14 and being disposed in abutment between the second housing part 13 and the first sliding sleeve 21.

The centralizer arrangement 11 operates as follows. The first coil spring 24 exerts an axial force substantially along the longitudinal axis XX' of the production logging tool 1. The axial forces acts onto the first sliding sleeve 21 that slide onto the stem 14. Thus, the first coil spring 24 causes radial forces that acts on the articulated centralizer arms 15, 16 and associated bows 17 urging them to move radially outwardly toward the well bore wall or the production pipe wall 6 until an outmost extended position corresponding to the bows 17 being urged into engagement with the surface of the wall 6. When the production logging tool 1 is run into a hydrocarbon well 2 having diameter that changes, in particular through restriction of smaller diameter, the wall 6 acts on the articulated centralizer arms 15, 16 and associated bows 17 that are urged to move radially inwardly towards the stem 14. This causes an inwardly oriented axial force acting onto the first sliding sleeve 21 that slide onto the stem 14 in the other direction compressing the first coil spring 24. In an extreme configuration, the articulated centralizer arms 15, 16 and associated bows 17 may be fully retracted such as being parallel to the stem 14, lying on the stem circumference surface, flush with the external surface of the first and second housing parts 12, 13.

Figure 13A:
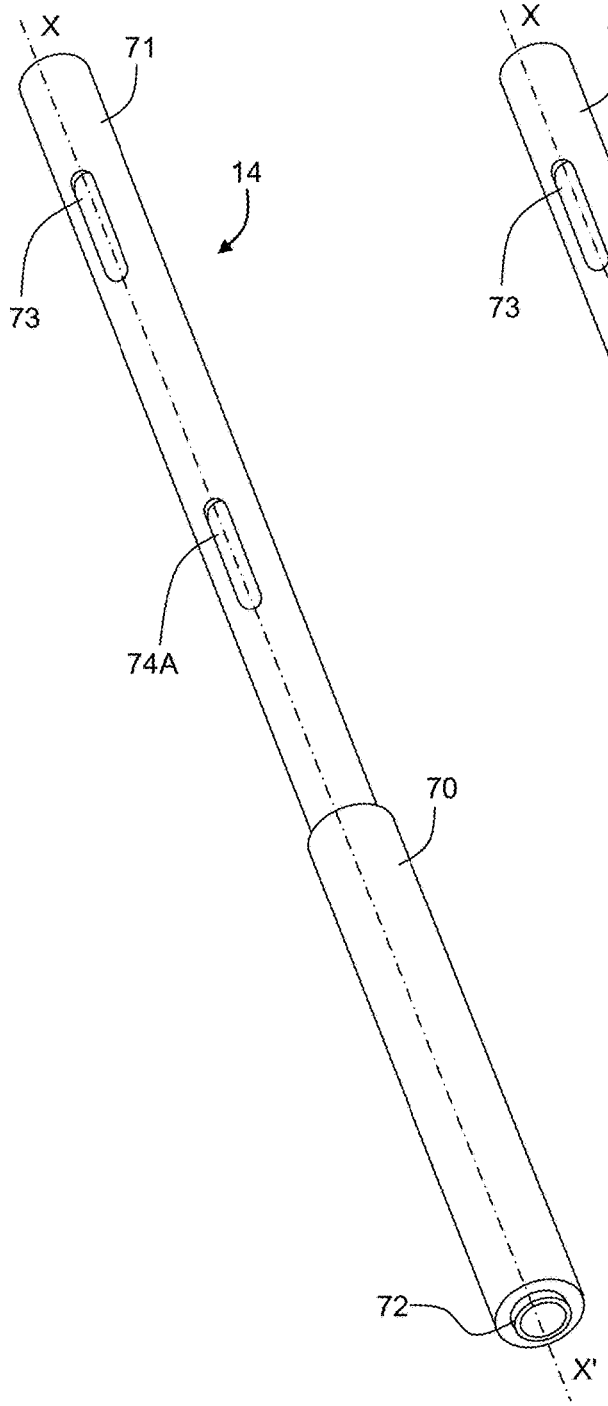
FIGS. 13A and 13B illustrate two exemplary embodiments of a stem with guiding slots.
Figure 13B:
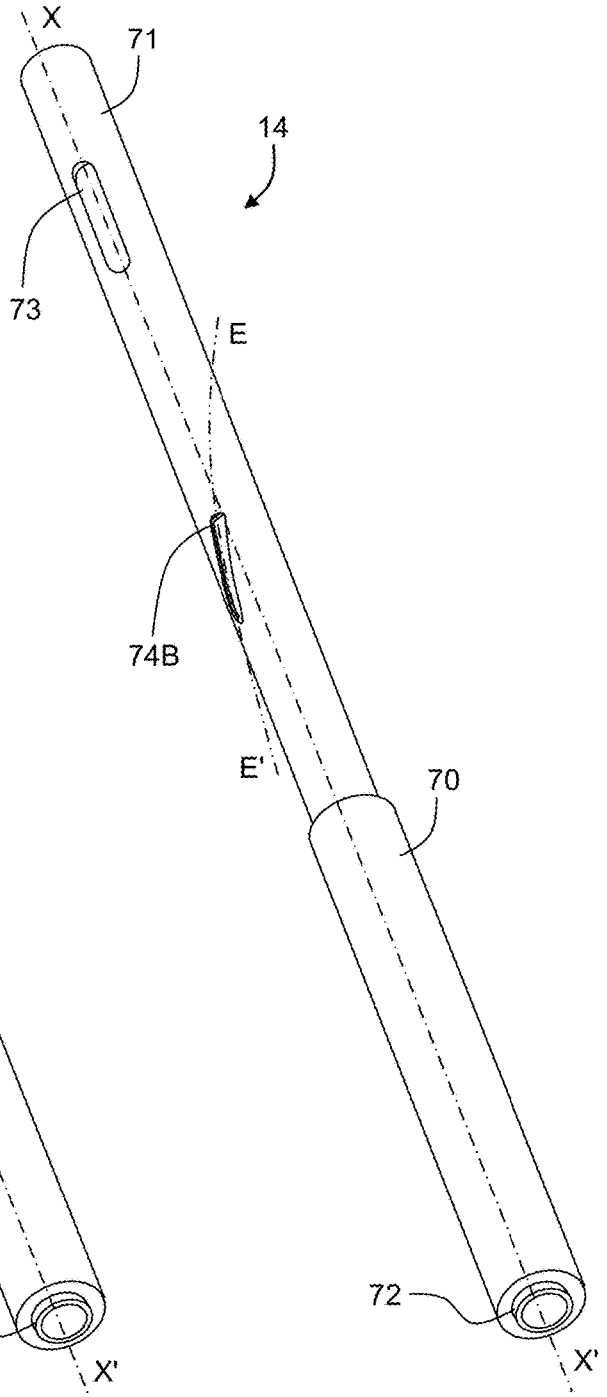

According to the present exemplary embodiment, each centralizer arm may further comprise at least one, for example two, downhole fluid properties analysis probe 50, 50A, 50B, 50C, 50D, 50E, 50F, 50G, 50H secured on an internal side (the inner face facing the stem 14) or on a lateral side of the first centralizer arm part 15, 15A, 15B, 15C, 15D such as to expose a tip 51 of said probe 50 to the multiphase fluid mixture flowing in the hydrocarbon well, and at the same time protect the tip 51 from a direct harmful contact with the wall 6 by means of the bows 17, 17A, 17B, 17C, 17D. Probe attachments 75 at the side of centralizer arms allows positioning the probe tips close to the center of the bow spring in contact with the well bore or pipe 6 and therefore allows measuring fluid properties close to the wall while being protected from direct contact to the wall by the centralizer arm structure. This configuration allows reducing damage risks on the probes during logging and/or deployment. In the description, a downhole fluid properties analysis probe 50, 50A-50H respectively 55, 55A-55H may be understood as a set including a probe electronic module 61 respectively 63, a pressure feed-through 53, a protective tube 52 and a tip 51. The probe electronic module 61 connected to the associated probe 50 is located in the first housing part 12. A protective tube 52 enclosing a link extends from the electronic module 61 to the tip 51 through a pressure feedthrough 53 into said housing 12. The downhole fluid properties analysis probe 50 may be of any type, namely mechanical, magnetic, optical, electrical, ultrasonic, spinner or mini-spinner, etc responsive to various physical entities like pressure, temperature, density, viscosity, conductivity, refractive index, fluid velocity, gas bubble and oil droplet counts and holdups, fluorescence, spectroscopic absorption, etc The production logging tool 1 further comprises a deploying arrangement 30 nested within the centralizer arrangement 11. The deploying arrangement 30 comprises articulated deploying arms 31, 32. Each articulated deploying arm includes a first arm part 31 and a second arm part 32 coupled together by an appropriate pivot connection, e.g. a hinge 33 at one of their ends. The first deploying arm part 31 may be longer than the second deploying arm part 32. In particular, the first deploying arm part 31 comprises an extension part 38 above the hinge 33. The deploying arms 31, 32 are coupled at a first side to a supporting member 34 of the stem 14 by a pivot connection, e.g. a hinge 35 and at a second side to a second sliding sleeve 36 by a pivot connection, e.g. a hinge 37. As an example, the present embodiment comprises a deploying arrangement 30 including four deploying arms 31A, 32A, 31B, 32B, 31C, 32C, 31D, 32D. The four deploying arms are spaced apart circumferentially about the longitudinal axis XX' of the production logging tool 1. The four deploying arms may be identical and equally spaced on the circumference. Each deploying arm 31A, 32A, 31B, 32B, 31C, 32C, 31D, 32D is positioned in a middle position between two centralizer arms 15A, 16A, 15B, 16B, 15C, 16C, 15D, 16D such that each deploying arm and centralizer arm can move free of obstruction from the stem 14 towards the wall 6 and vice-versa. The first sliding sleeve 21 is prevented from rotation by using a radial pin (not shown) extending inwardly and arranged to slide inside a longitudinal slot 73 (parallel to the longitudinal axis XX') machined on the outer surface of the stem 14 (visible in FIGS. 13A and 13B). The second sliding sleeve 36 also has a radial pin (not shown) extending inwardly and arranged to slide inside a second longitudinal slot 74A (parallel to the longitudinal axis XX') machined on the outer surface in the stem 14 (see FIG. 13A). Thus, the second sliding sleeve 36 is prevented from rotating and deploying arms 31, 32 are maintained in a middle position for any opening of the centralizer arrangement 11. The second sliding sleeve 36 is rigidly coupled to the first sliding sleeve 21 through a mechanical coupler (a tube) 39. The second sliding sleeve 36 is also coupled to the stem 14 through a second coil spring 40.

Each deploying arm comprises at least one, for example two, downhole fluid properties analysis probe 55, 55A, 55B, 55C, 55D, 55E, 55F, 55G, 55H secured on the extension part 38 of the first deploying arm part 31. Said probes 55, 55A-55H are similar to the one described in relation with the centralizer arrangement except that the electronic module 63 connected to the associated probe 55 is located in the second housing part 13. The downhole fluid properties analysis probes 55, 55A, 55B, 55C, 55D are then positioned in-between the deploying arrangement 30 and the centralizer arrangement 11. As the deploying arrangement 30 is nested within the centralizer arrangement 11, this enables exposing the tip 51 of the probe 55 to the multiphase fluid mixture flowing in the hydrocarbon well with a robust control of its radial and angular position therefore protecting the tip 51 from a direct harmful contact with the wall 6 or other components of the centralizer arrangement 11. Probe attachments 75 are secured on deploying arms allowing reducing damage risks during logging and/or deployment.

Figure 5:
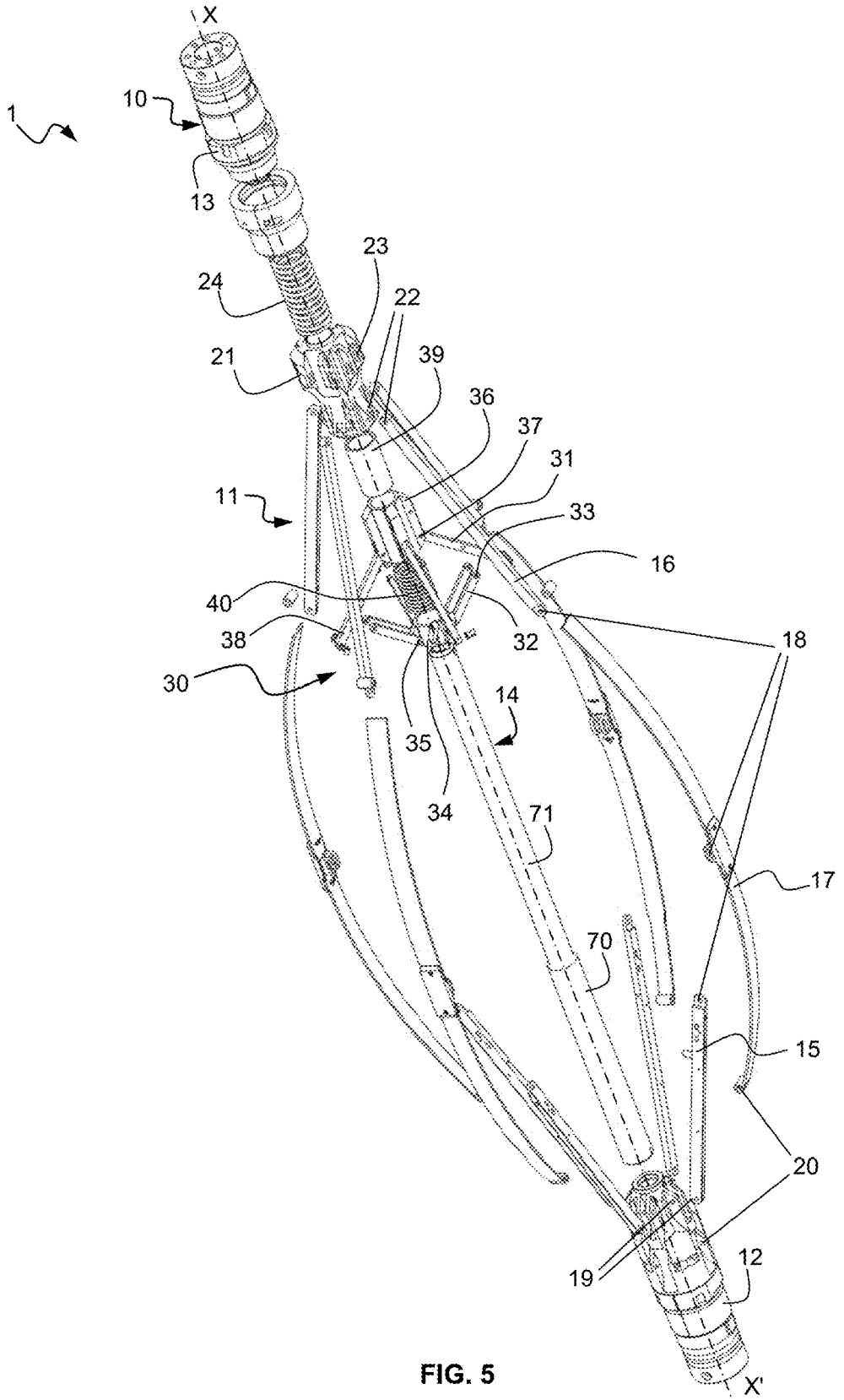
FIG. 5 is an exploded perspective view of the embodiment of the production logging tool PLT of the invention without the downhole fluid properties analysis probes.
Figure 6:
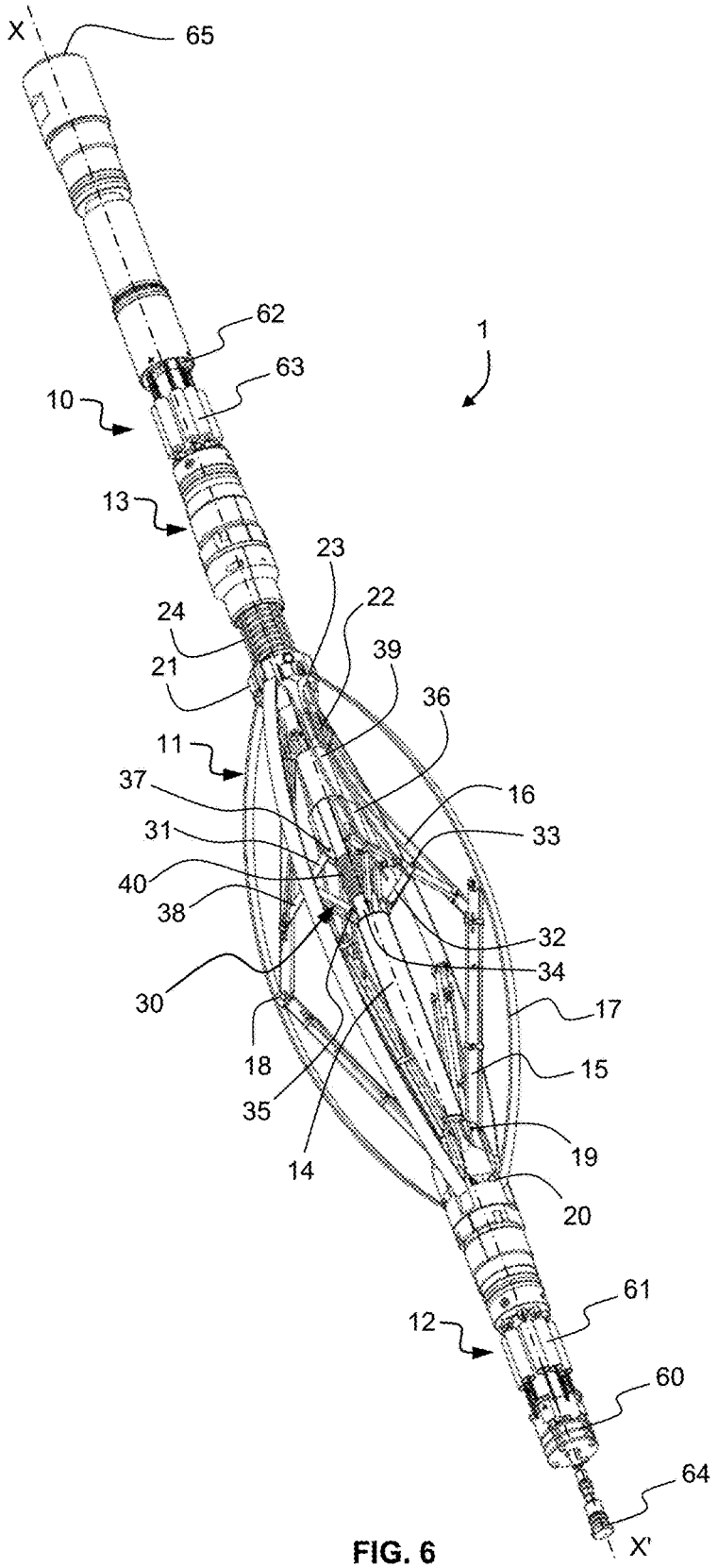
FIGS. 6, 7, 8 and 9 illustrate a main implementation example of the embodiment of the production logging tool PLT of the invention comprising sixteen probes.
Figure 13C:
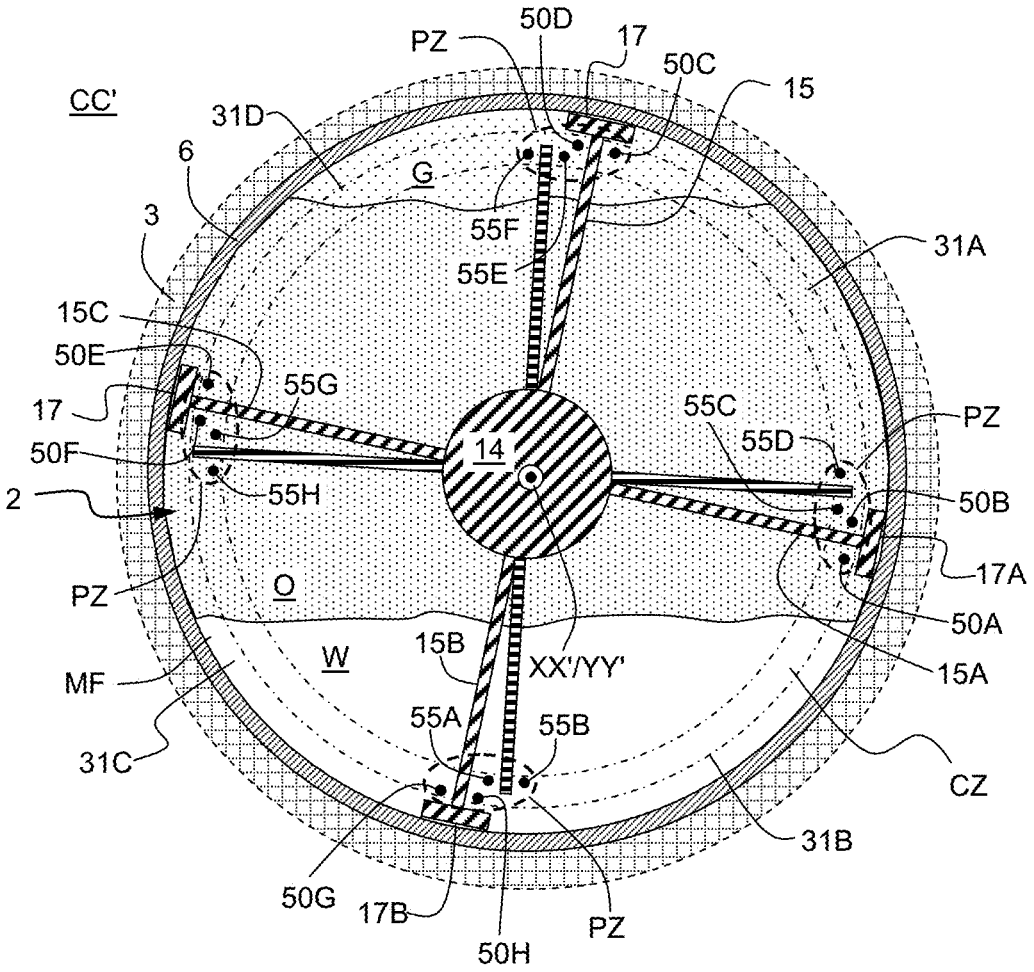
FIG. 13C is a cross-section view in a horizontal hydrocarbon well schematically illustrating the operation of the production logging tool PLT of the invention in segregated fluid mixture flowing through the wellbore with the stem of FIG. 13B.

As depicted in FIG. 5, the stem comprises a first part 70 and a second part 71. The second part 71 has a diameter superior to the first part 70 forming an abutment to stop the axial movement of the supporting member 34. Both first part 70 and second part 71 have a welded or threaded connection 72 (only one being visible) at their respective ends for connection with the first and second housing part 12 and 13, respectively. Differing from the stem hereinbefore described (hollow tube with longitudinal slots), FIG. 13 illustrates an alternative embodiment of the stem 14 that comprises a helical guiding slot 74B disposed on the circumference surface of the stem and directed according to a curved axis EE' inclined with respect to the longitudinal axis XX'. The first guiding slot 73 is a longitudinal guiding slot 73 directed parallel to the longitudinal axis XX'. The longitudinal guiding slot 73 cooperates with a radial pin (not shown) in the first sliding sleeve 21 for guiding along a straight path the sliding of the first sliding sleeve 21 on the stem 14. The second guiding slot is a helical guiding slot 74B. The helical guiding slot 74B cooperates with another radial pin (not shown) in the second sliding sleeve 36 for guiding with a limited and defined rotational movement the sliding of the second sliding sleeve 36 on the stem 14. This configuration allows having the deploying arms 31, 32 to be placed in a middle position when the tool is completely closed for optimal probes positioning. During tool opening, the deploying arms 31, 32 follow centralizer arms 15, 16 radial movements and modify their angular positions to stay as close as possible to centralizer arms 15, 16. FIG. 13C depicts such a situation where the tool is completely opened. This is useful when probes of different types need to make measurements on substantially the same point or around the same point (punctual zone PZ) within the circumferential zone CZ in order to interpret complex fluid conditions.

Figure 3:
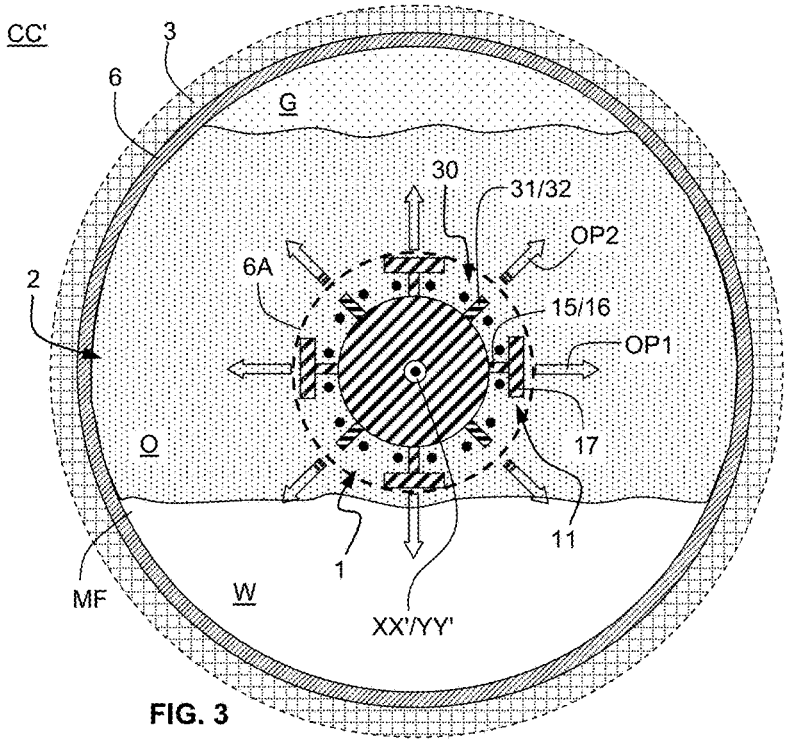
Figure 4A:
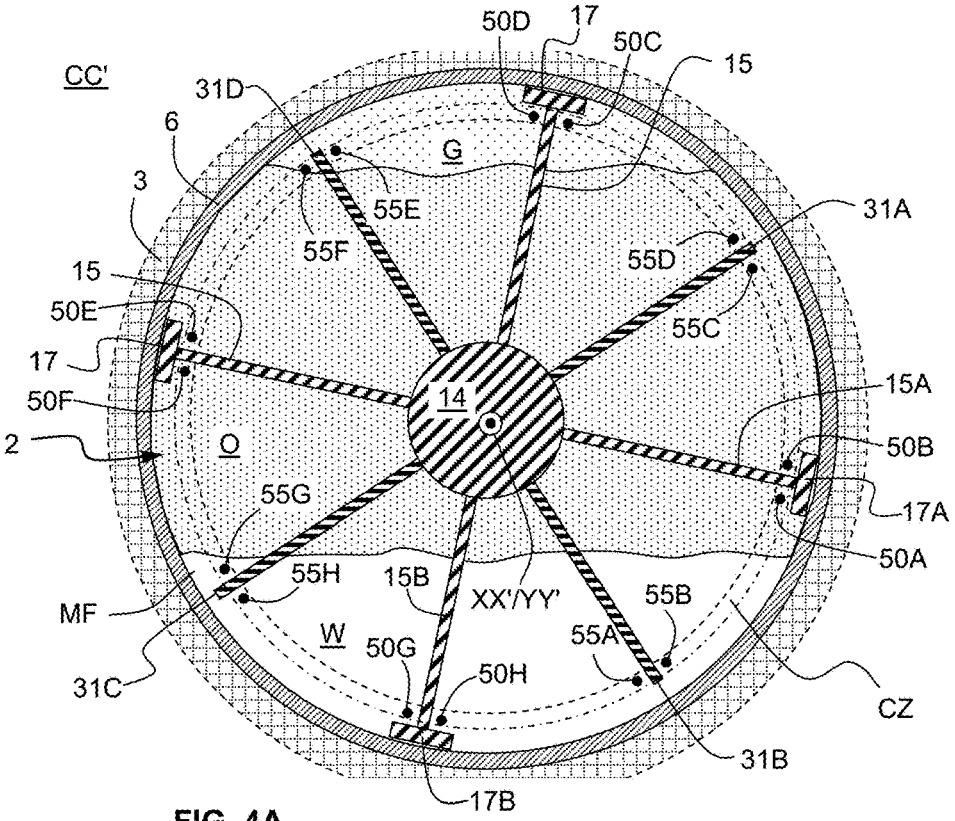

The second sliding sleeve 36 associated with the stem 14 forms a radial and/or rotational deploying means for radially and/or angularly positioning the tips 51 of the downhole fluid properties analysis probes 55, 55A, 55B, 55C, 55D, 55E, 55F, 55G, 55H associated with each deploying arm 31 within a circumferential zone CZ of the hydrocarbon well section, preferably close to the pipe or bore wall 6 (see FIG. 4A). Thus, the movement of the centralizer arrangement 11 causes the tips 51 of said downhole fluid properties analysis probes 55 associated with each deploying arm 31, 32 and the tips 51 of said downhole fluid properties analysis probes 50, 50A, 50B, 50C, 50D, 50E, 50F, 50G, 50H associated with each centralizer arm 15, 16 to substantially follow well section diameter as depicted in FIGS. 3 and 4. In particular, FIG. 3 illustrates the production logging tool 1 being moved through a restriction 6A (depicted as a dotted line) having a first inner diameter (though slightly superior to the outer diameter of the production logging tool 1) towards a well bore or pipe 6 of standard size having a second inner diameter superior to the first one. When leaving the restriction 6A, the centralizer arrangement 11 including the bows 17, 17A, 17B, 17C, 17D and the centralizer arms 15, 16, 15A, 15B, 15C, 15D, 16A, 16B, 16C, 16D opens (arrows OP1) towards the well bore or pipe wall 6 in order to follow the wellbore or pipe inner diameter, and at the same time controls the opening (arrows OP2) of the deploying arrangement 30 including the deploying arms 31, 32, 31A, 31B, 31C, 31D, 32A, 32B, 32C, 32D.

Thus, according to the embodiment depicted in FIG. 1, the radial and/or rotational deploying means of the deploying arrangement 30 is operating in a passive manner. The second sliding sleeve 36 is mechanically coupled to the first sliding sleeve 21 by the mechanical coupler 39. The mechanical coupler 39 may be a collar extending around the stem 14 and free to slide onto the stem 14. This mechanical coupling enables the second sliding sleeve 36 to follow the movement imposed by the first sliding sleeve 21. Therefore, the deploying arms 31, 32 of the deploying arrangement 30 are deployed in conjunction with the centralizer arms 15, 16 of the centralizer arrangement 11. Further, the length L of the mechanical coupler 39 defines the radial position R of the probe tip. The mechanical coupler 39 of a defined length can be replaced by another one of different length to adapt the radial position R of the probe tip depending on desired position of measurements to be performed into a well section. The deploying arrangement 30 further comprises a second axial spring element, e.g. a second coil spring 40 extending around the stem 14 and being disposed in abutment between the supporting member 34 and the second sliding sleeve 36.

Therefore, the production logging tool 1 comprises a first set of downhole fluid properties analysis probes 50, 50A-

50H associated with the centralizer arrangement 11 and extending from one end of the tool (i.e. from the first housing part 12), and a second set of downhole fluid properties analysis probes 55, 55A-55H associated with the deploying arrangement 30 and extending from the other end of the tool (i.e. from the second housing part 13). The measuring points (also corresponding to the black dots visible in FIGS. 4A and 4B) associated to each downhole fluid properties analysis probe may be substantially positioned in a similar plane (or close planes) perpendicular to the well bore axis YY' and in a similar circumferential zone CZ of the hydrocarbon well section. This enables increasing the measuring points (in term of numbers, and/or of measurement types) over the section of the well bore as depicted in FIG. 4A which schematically illustrates a cross-section view in a horizontal hydrocarbon well where a segregated fluid mixture MF flows through the wellbore 2.

Figure 4B:
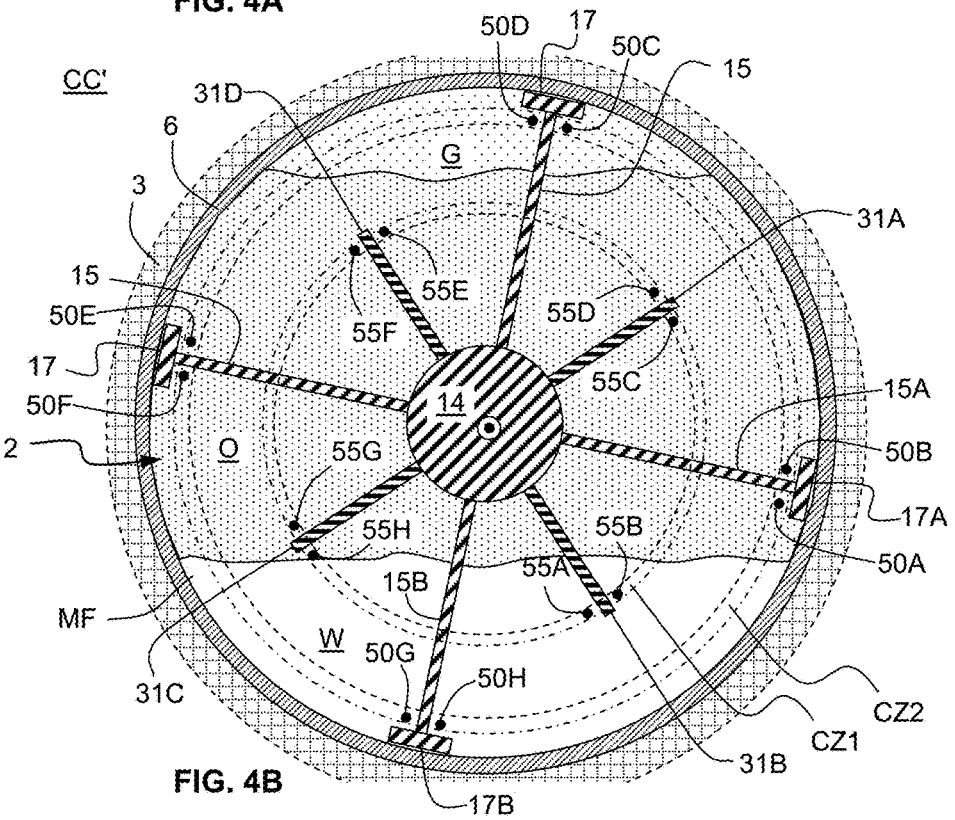

However, the radial extension of the probes (the radial position R of the probe tip) carried by the deploying arrangement 30 may also be adjusted by adjusting the length of the extension part 38. For example, it may be adjusted to define a radial extension lower than that of the centralizer arrangement 11. Thus, the measuring points associated to each downhole fluid properties analysis probe may be substantially positioned in a similar plane (or close planes) perpendicular to the well bore axis YY' but in different circumferential zones CZ1 and CZ2 of the hydrocarbon well section as depicted in FIG. 4B. Depending on the diversity of conditions, it is possible to set the distance of the circumferential zones to the wall 6 in order to measure either at the periphery of the well section, namely close to the wall (for example in horizontal well, this is interesting to measure segregation or low holdup, thin layer of gas at the top and water at the bottom) or to cover a larger area extending from the periphery to the longitudinal axis of the well YY' (for example in vertical well or inclined well). The diversity of conditions is related to the inclination of the well or type of multiphase fluid mixture (i.e. containing lot of water vs. lot of gas).

In addition, the production logging tool 1 may rotate about its axis under the effect of the friction of the bows of the centralizer arrangement 11 on the wall of the well or pipe. This may result in sweeping the circumferential zones (CZ respectively CZ1 and CZ2) of the well section in a random manner.

FIGS. 6-9 illustrate a main implementation example of the production logging tool 1 comprising sixteen downhole fluid properties analysis probes. The centralizer arrangement 11 comprises four centralizer arms. The deploying arrangement 30 comprises four deploying arms. Each centralizer arm 15A, 16A, 15B, 16B, 15C, 16C, 15D, 16D of the centralizer arrangement 11, in particular each first centralizer arm part 15A, 15B, 15C, 15D comprises two downhole fluid properties analysis probes 50A and 50B, 50C and 50D, 50E and 50F, 50G and 50H secured to each centralizer arm on each lateral side, respectively. Each deploying arm 31A, 32A, 31B, 32B, 31C, 32C, 31D, 32D of the deploying arrangement 30, in particular each first deploying arm part 31A, 31B, 31C, 31D further comprises two downhole fluid properties analysis probes 55A and 55B, 55C and 55D, 55E and 55F, 55G and 55H secured to each deploying arm on each lateral side. The sixteen probes enables scanning circumference of the hydrocarbon well section in an efficient manner (see FIGS. 3 and 4A, 4B), therefore achieving a substantial coverage of the wellbore section and detecting thin layers of fluids produced. This is particularly advantageous in deviated and horizontal hydrocarbon well where fluid mixture (oil, gas, water) flows in a highly segregated manner. According to this example, the sixteen probes are of the magnetic, optical, electrical, or ultrasonic type, or a combination of at least two of these types comprising a flat tip or a needle shaped tip.

In a particular tool configuration, the probes 55A, 55C, 55E, 55G are conductivity probes measuring water holdup; the probes 55B, 55D, 55F, 55H are optical probes measuring gas holdup; the probes 50A, 50C, 50E, 50G are fluorescence probes measuring oil holdup; and the probes 50B, 50D, 50F, 50H are mini-spinner probe measuring fluid velocity.

In another tool configuration, the probes 55A, 55B, 55C, 55D, 55E, 55F, 55G, 55H are three phase optical probes measuring gas-oil-water holdups; the probes 50A, 50B, 50C, 50D, 50E, 50F, 50G, 50H are ultrasonic doppler probe measuring fluid velocity.

Figure 10:
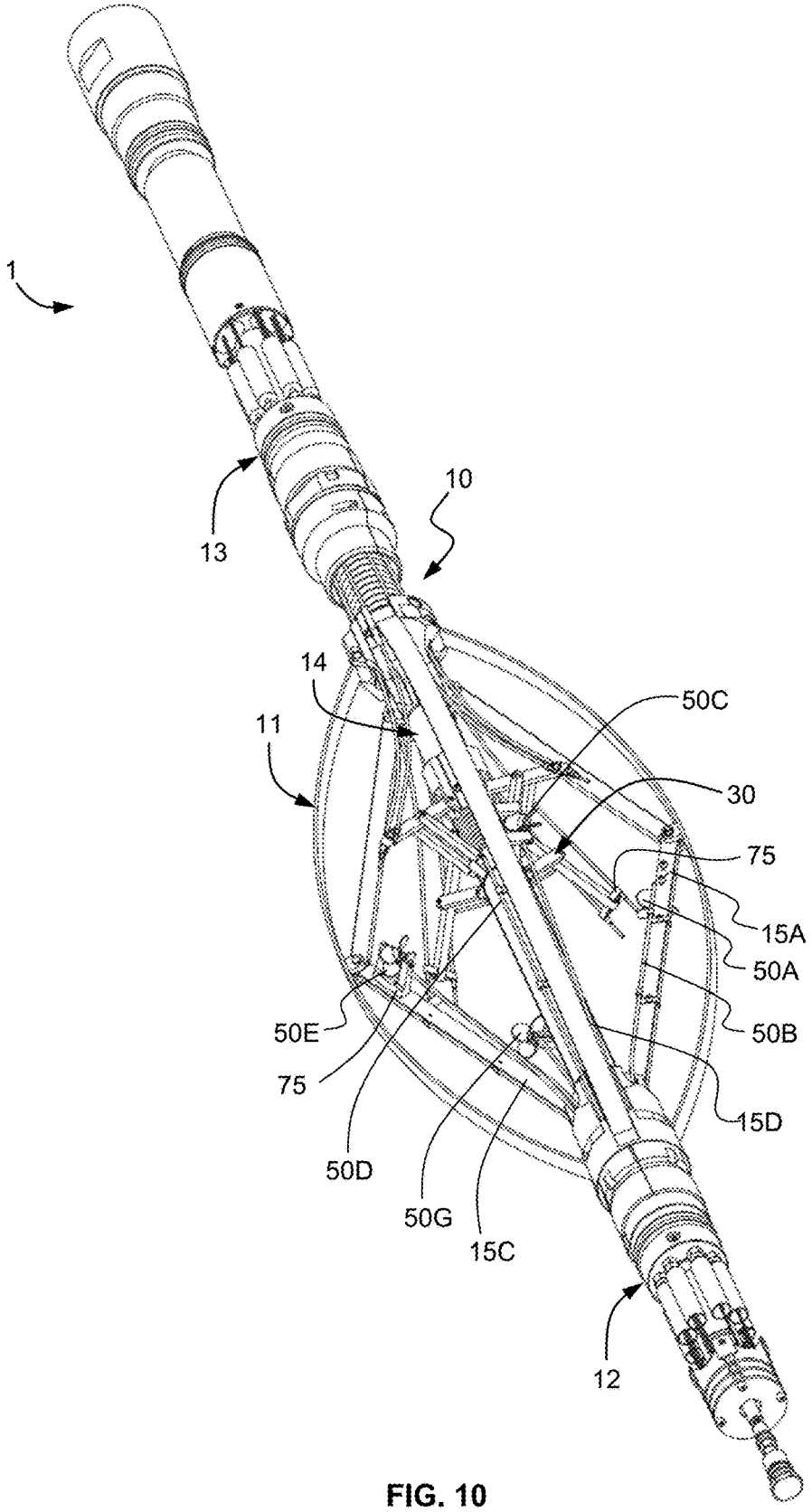
FIGS. 10, 11 and 12 illustrate another implementation example of the embodiment of the production logging tool PLT of the invention comprising sixteen probes including micro-spinners.
Figure 12:
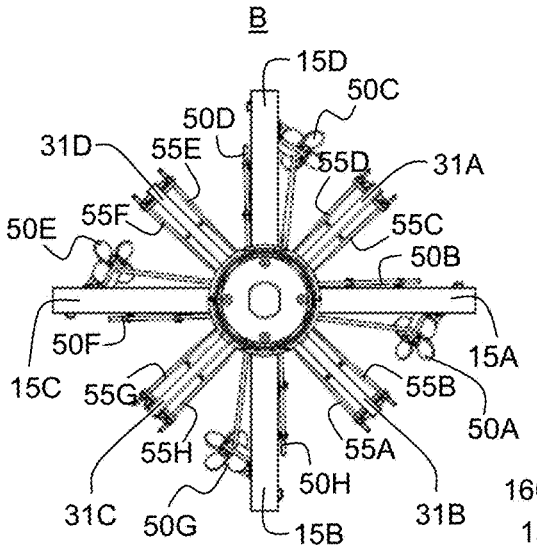
Figure 11:
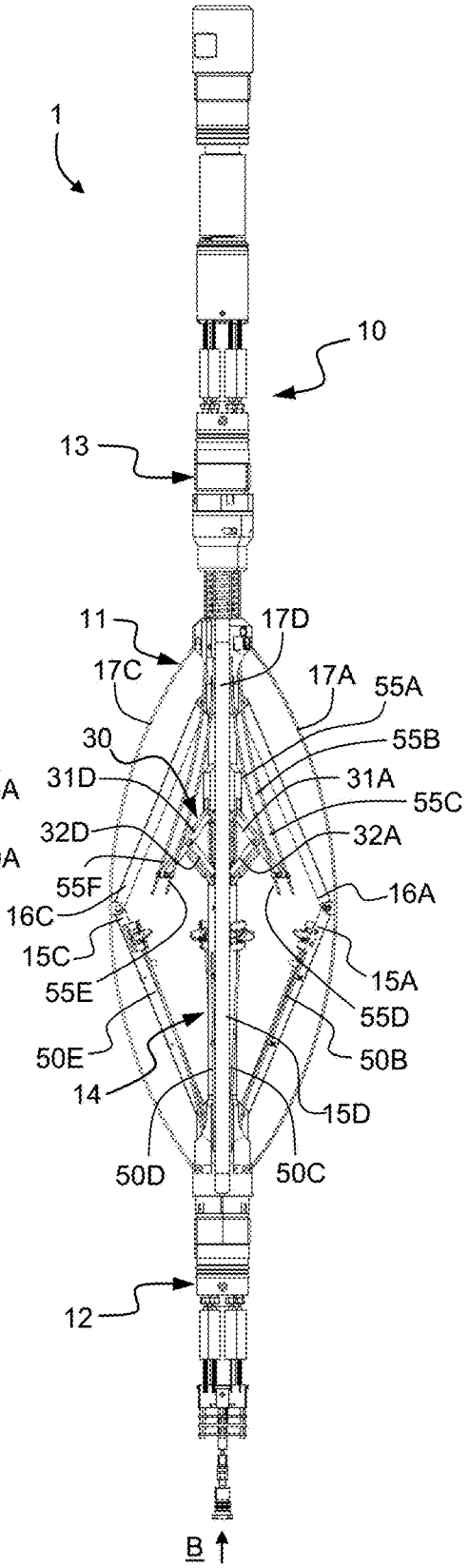

FIGS. 10-12 illustrate another implementation example of the embodiment of the production logging tool 1 comprising sixteen downhole fluid properties analysis probes. The second alternative differs from the first one in that four downhole fluid properties analysis probes 50A, 50 C, 50E and 50G secured to the centralizer arms 15A, 15B, 15C, 15D of the centralizer arrangement 11 are replaced by spinner measuring fluid mixture speed. Therefore, the tip of those four downhole fluid properties analysis probes comprises a mini-spinner.

With the production logging tool of the invention, it is possible to achieve:

- High coverage of wellbore section, probe sensors approaching contact with pipe wall to detect presence of ultra thin phases flowing at the top or bottom of the pipe.
- Fluid identification measurements can be focused on area of pipe section with most interest such as phases interfaces for accurate holdups imaging.
- Velocity measurements can be focused on area of pipe section with minimal perturbations, in the bulk of phases away from interfaces.
- Minimal perturbation of flow from tool structure is obtained thanks to the original mechanical structure of the tool.
- Integrated inclination and azimuth.
- Interchangeable probes in order to adapt to specific production issues. The production logging tool can be installed indifferently with conductive, capacitive, optical reflection, optical fluorescence, active ultrasonics, passive ultrasonics, high resolution temperature.
- Design compatible with all type of probe sensor such as electrical, optical, ultrasonic, high resolution temperature.
- Robust design allowing deployment in openhole sections.
- Operation in memory mode for operations where electrical cable telemetry is not available such as coiled tubing deployment.

The production logging tool structure of the invention is simple, compact achieving low cost and easy operation and maintenance.

The design is based on a 2D array of probes which can be displaced radially and angularly in order to cover the circumference of the pipe.

The probe deployment is secured by the tool centralizer arrangement allowing reducing damage risks during logging and allowing measurements up to the pipe wall.

It should be appreciated that embodiments of the production logging tool according to the present invention are not limited to the embodiment showing horizontal hydrocarbon well bore, the invention being also applicable whatever the configuration of the well bore, namely vertical, deviated or a succession of vertical, deviated and/or horizontal portions, cased or uncased. Also, the deploying apparatus of the invention is not limited to an application into a production logging tool, but can be easily adapted to various applications into analysis tools operating at downhole pressure and temperature conditions, e.g. a downhole fluid analysis tool, a wireline tool, a formation tester.

The invention claimed is:

1. A production logging tool to analyze at least one property of a multiphase fluid mixture flowing in a hydrocarbon well has an elongated cylindrical housing shape and comprises a central pressure-resistant rigid housing carrying a centralizer arrangement comprising multiple external centralizer arms circumferentially distributed about said housing and adapted for contact with a production pipe wall of a hydrocarbon well and operable from a retracted configuration into a radially extended configuration, the centralizer arms being coupled at a first side to the housing and at a second side to a first sliding sleeve and a first spring, wherein the production logging tool further comprises a deploying arrangement nested within the centralizer arrangement, the deploying arrangement comprising:

a plurality of deploying arms circumferentially distributed about said housing and being coupled at a first side to the housing and at a second side to the centralizer arrangement by means of at least one second sliding sleeve such that each deploying arm is circumferentially positioned between two centralizer arms whatever the retracted or radially extended configuration of the centralizer arrangement, at least one downhole fluid properties analysis probe being secured on each deploying arm such as to expose a tip of said, at least one, probe to the multiphase fluid mixture flowing in the hydrocarbon well, wherein the second sliding sleeve comprises a mechanical coupler coupled to the first sliding sleeve such that the deploying arrangement follows radial movements imposed by the centralizer arrangement to radially and/or angularly position the tip of said, at least one, probe associated with each deploying arm in a first circumferential zone of a hydrocarbon well section substantially perpendicular to a longitudinal axis of said well.

2. The production logging tool of claim 1, at least one other downhole fluid properties analysis probe is secured on an inner or lateral face of each centralizer arm such as to expose a tip of said, at least one, other probe to the multiphase fluid mixture flowing in the hydrocarbon well.

3. The production logging tool of claim 2, wherein the centralizer arrangement is arranged to radially and/or angularly position the tip of said, at least one, probe associated with each centralizer arm in a second circumferential zone of the hydrocarbon well section substantially perpendicular to the longitudinal axis of the well.

4. The production logging tool of claim 3, wherein the first and second circumferential zone are the same.

5. The production logging tool of claim 1, wherein a second spring is positioned between the second sliding sleeve and the housing at the first side of the deploying arrangement.

6. The production logging tool of claim 1, wherein the first sliding sleeve and the second sliding sleeve are supported by a stem of the central pressure-resistant rigid housing, the stem comprising a longitudinal or an helical guiding slot cooperating with a radial pin of the second sliding sleeve.

7. The production logging tool of claim 1, wherein each deploying arm of the deploying arrangement comprises an extension part, a length of the extension part defining a radial extension of the tip of the downhole fluid properties analysis probe carried by the deploying arm.

8. The production logging tool of claim 1, wherein the deploying arrangement comprises at least four centralizer arms and at least four deploying arms, each deploying arm being nested in-between two adjacent centralizer arms.

9. The production logging tool of claim 1, wherein two downhole fluid properties analysis probes are secured on lateral faces of each deploying arm.

10. The production logging tool of claim 1, wherein two downhole fluid properties analysis probes are secured on lateral faces or on one inner face and one lateral face of each centralizer arm.

11. The production logging tool of claim 1, wherein said, at least one, probe associated with the centralizer arms is connected to an electronic module located into a first housing part, said, at least one, other probe associated with the deploying arms is connected to another electronic module located into a second housing part, a protective tube extending from each electronic module to the tip along the respective arm through a pressure feedthrough of said respective housing part.

12. A method of deploying downhole fluid analysis probes in a hydrocarbon well in which a multiphase fluid mixture flows, comprising the steps of:

providing a production logging tool having an elongated cylindrical housing shape and comprising a central pressure-resistant rigid housing carrying a centralizer arrangement including a plurality of centralizer arms, circumferentially distributed about said housing and operable from a retracted position into a radially extended position and a deploying arrangement including a plurality of deploying arms circumferentially distributed about said housing, each deploying arm being circumferentially positioned between two centralizer arms and carrying at least one downhole fluid analysis probe, said probe deploying arrangement being coupled to said centralizer arrangement so that radial extension of the centralizer arms results in radial extension of the deploying arms, positioning the production logging tool in a section of a hydrocarbon well in which multiphase fluid flow is to be analyzed, allowing the centralizer arms to radially extend into engagement with the wall of the well, whereby the deploying arms are extended radially and the downhole fluid analysis probes are deployed in positions circumferentially located between two centralizer arms and radially located in a first circumferential zone of a hydrocarbon well section substantially perpendicular to a longitudinal axis of said well.

13. The deploying method of claim 12, further comprising providing at least one downhole fluid analysis probe carried on each centralizer arm and deploying said downhole fluid analysis probes in a second circumferential zone of a hydrocarbon well section substantially perpendicular to a longitudinal axis of said well.

14. The deploying method of claim 13, wherein said probes carried by deploying arms and said other probes carried by centralizer arms are positioned, when deployed, in the same plane perpendicular to a longitudinal axis of the hydrocarbon well.

15. The deploying method of claim 13, wherein the first and second circumferential zone are the same.

16. An apparatus for deploying in a hydrocarbon well a plurality of probes for analyzing at least one property of a multiphase fluid mixture flowing in the hydrocarbon well, having an elongated cylindrical housing shape and comprising a central pressure-resistant rigid housing carrying a centralizer arrangement comprising multiple external centralizer arms circumferentially distributed about said housing and adapted for contact with a production pipe wall of a hydrocarbon well and operable from a retracted configuration into a radially extended configuration, the centralizer arms being coupled at a first side to the housing and at a second side to a first sliding sleeve and a first spring, wherein the apparatus further comprises a deploying arrangement nested within the centralizer arrangement, the deploying arrangement comprising:

a plurality of deploying arms circumferentially distributed about said housing and being coupled at a first side to the housing and at a second side to the centralizer arrangement by means of at least one second sliding sleeve such that each deploying arm is circumferentially positioned between two centralizer arms whatever the retracted or radially extended configuration of the centralizer arrangement, a plurality of probe attachments for respectively securing probes on each deploying arm and each centralizer arm such as to expose a tip of said probes when secured to said probe attachments to the multiphase fluid mixture flowing in the hydrocarbon well, wherein the second sliding sleeve comprises a mechanical coupler coupled to the first sliding sleeve such that the deploying arrangement follows radial movements imposed by the centralizer arrangement to radially and/or angularly position the tip of said probes when respectively secured to said probe attachments in a first circumferential zone of a hydrocarbon well section substantially perpendicular to a longitudinal axis of said well, and wherein the centralizer arrangement is arranged to radially and/or angularly position the tip of said other probes when respectively secured to said probe attachments in a second circumferential zone of the hydrocarbon well section substantially perpendicular to the longitudinal axis of the well.

* * * * *